US006145324A

United States Patent [19]

Dolezal

[11] Patent Number: 6,145,324

[45] **Date of Patent: *Nov. 14, 2000**

[54] APPARATUS AND METHOD FOR MAKING ICE

[75] Inventor: Donald Dolezal, Dallas, Tex.

[73] Assignee: Turbo Refrigerating, Denton, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 09/212,847

[22] Filed: Dec. 16, 1998

[51] Int. Cl.[7] ..... F25C 5/10

[52] U.S. Cl. ..... 62/73; 62/348; 62/352

[58] Field of Search ..... 62/74, 73, 347, 62/348, 352

[56] References Cited

U.S. PATENT DOCUMENTS 3,759,048 9/1973 Cochran ..... 62/73
4,044,568 8/1977 Hagen ..... 62/73
4,094,168 6/1978 Hamner et al. ..... 62/347
5,203,176 4/1993 De Weered ..... 62/352

*Primary Examiner*—William E. Tapolcai
*Attorney, Agent, or Firm*—Theodore F. Shiells; Gardere and Wynne, L.L.P.

[57] ABSTRACT

An apparatus and method for making and harvesting ice. Gaseous refrigerant is directed from a suction accumulator to a compressor, then to a condenser wherein the gaseous refrigerant is condensed into a liquid and through an expansion valve which reduces the pressure of the liquid refrigerant, which is then directed into the ice making plates to evaporate the refrigerant to cool the plates while water from a water supply circuit is flowed over a cold outer surface of the ice making plates allowing ice to form. During a harvest cycle, gaseous refrigerant from the compressor is directed into the ice making plates to be condensed into a liquid in the ice making plates, warming the plates to release the ice. Liquid refrigerant from the plates is directed to harvest gas generation plate and water is flowed over an outer surface of the gas generation plate, warming the refrigerant to a gaseous state, while cooling the water in preparation for the next ice making cycle.

6 Claims, 4 Drawing Sheets

APPARATUS AND METHOD FOR MAKING ICE

FIELD OF THE INVENTION

This invention relates, in general, to an apparatus and method to make ice and, in particular, to a more efficient harvest cycle that condenses hot gas to harvest the ice, and then evaporates the liquid refrigerant in a harvest gas generator by flowing make-up water over the plate, chilling the make-up water for the next ice making cycle.

BACKGROUND OF THE INVENTION

Ice makers for producing and harvesting ice are known. Prior art ice makers typically use a conventional vapor compression refrigeration cycle to produce the ice on plates. An ice harvest cycle is then used to harvest the ice.

Some prior art ice makers use a water defrost harvest that produces a dry, sub-cooled ice fragment. Ice is formed on only one surface of the evaporator surface. The other ice side of the evaporator surface is used for application of the defrost water to remove the ice. This type of ice maker is advantageous for its dry, sub-cooled ice fragment, which is preferred by many customers.

Other prior art ice makers use a hot gas generation to harvest the ice from the evaporator surface. However, these ice makers tend to produce a wet ice due to the heat input from their hot gas harvest method, require more complex refrigeration systems and are not as simple to operate and maintain as desired. Oil management and compressor flooding are typical problems on equipment of this design. In such prior art systems, to maintain a stable refrigeration system when the ice making (refrigeration) load is removed during harvest, either multiple harvests would be required or the compressor would have to be stopped and restarted. In addition, larger suction accumulators and special oil management schemes would have to be used to handle the liquid refrigerant condensed during the harvest cycle. Large burn-off coils would also be required in the suction accumulator to boil off the liquid refrigerant to convert it a gas so it could be safely returned to the compressor. Furthermore, gaseous refrigerant generated by the evaporation of the liquid in the suction accumulator would create an additional load on the compressor and reduce the useful work, i.e., capacity, of the compressor in the ice making process. Although the liquid sub-cooling, resulting from the evaporation of the liquid, would offset some of the earlier compressor losses during the burn-off of the refrigerant, the additional liquid sub-cooling was not available during the entire cycle, making control of the refrigerant under all operating conditions more difficult. It is believed that compressor problems in previous systems were typically the result of the large quantities of refrigerant being rejected to the suction accumulator when the evaporator returned to the ice making mode following a harvest cycle.

The ice maker of the present invention has an integral ice making and ice harvest circuit and unique harvest gas generation system which combines the best features of the other ice makers to obtain a superior dryer product while eliminating oil management problems, compressor flooding, and complex operating systems.

The present invention produces ice on the evaporator plates in the conventional manner, and can use both sides of the evaporator plates. To harvest the ice, hot refrigerant gas is introduced to the evaporator, where it is condensed, raising the temperature of the plate and freeing the ice. The condensed refrigerant is then delivered to a harvest gas generator plate, which takes the condensed liquid refrigerant from the ice making plates and, by flowing make-up water which evaporates the liquid refrigerant while pre-cooling water for the next ice-making cycle. This is accomplished while maintaining a stable refrigeration system operation (with the compressor operating) even though the normal refrigeration load is removed, i.e., the ice making process is terminated.

The evaporation of the condensed liquid in the gas generator plate while pre-cooling incoming make-up water for the next ice making cycle converts the condensed liquid to useful work, rather than resulting in energy losses from the burn-off of large refrigerant quantities in the suction accumulator, as in conventional hot gas harvest systems. The gas generator circuit also eliminates the liquid handling and oil management problems of prior systems while using a standard, smaller suction accumulator with a built-in oil return system. Thus, external oil management systems are not required, resulting in a tremendous cost savings and a more efficient system. Even with the smaller physical size of the system, the capacity (ice production) is higher (approximately 70%) other than other ice makers with the same amount of evaporator surface.

SUMMARY OF THE INVENTION

In accordance with a preferred embodiment of the present invention, an ice making and harvesting system includes a refrigerant system having a refrigerant compressor; a condenser having an outlet; an expansion valve to reduce the pressure of the refrigerant flowing from the condenser; at least one ice making plate; a harvest gas generator plate; a valve to selectively direct gaseous refrigerant from the compressor towards the condenser during an ice making cycle and towards said ice making plate during a harvest cycle; a suction accumulator; a heat exchanger having one side associated with said suction accumulator and one side associated with an outlet of said condenser; and a valve on the downstream side of said ice making plate to selectively direct refrigerant from the ice making plate to the suction accumulator during an ice making cycle and from the harvest gas generator plate to the suction accumulator during a harvest cycle. The system also includes a water supply circuit having a first upper water source for said ice making plate; a second upper water source for said harvest gas generator plate; a lower water tank; a pump for pumping water from said lower water tank to said first and second upper water sources; a source of make-up water; and a water supply valve for selectively directing water to said first upper water source to flow over said ice making plate during an ice making cycle and a water supply valve for selectively directing water to said second upper water source to flow over said harvest gas generator plate during a harvest cycle.

In accordance with a preferred aspect of this embodiment, the first upper water source is a water pan and said second upper water source is a water pan.

In accordance with another preferred aspect of this embodiment, the suction accumulator further includes an oil return system collecting oil from the refrigerant having a U-shaped tube and a weep hole in the U-shaped tube to return the collected oil to the compressor.

In accordance with another embodiment of the present invention, a method for making and harvesting ice comprises the steps of, during an ice making cycle, directing liquid refrigerant to an ice making plate while flowing water over said ice making plate to evaporate said liquid refrigerant into a gas and create a layer of ice on said ice making plate; during a harvest cycle, directing gaseous refrigerant to an ice making plate having ice thereon; condensing said gaseous refrigerant in said ice making plate to warm said ice making plate and loosen said ice; directing condensed refrigerant from said ice making plate to a harvest gas generator plate; flowing water onto said harvest gas generator plate to warm said harvest gas generator plate and evaporate said condensed refrigerant into a gaseous refrigerant while cooling said water above its freezing point; directing said gaseous refrigerant from said harvest gas generator plate to an accumulator vessel; directing water flowed onto said harvest gas generator plate into a water tank; and, during an ice making cycle, directing water from said water tank onto said ice making plate.

In accordance with a preferred aspect of this embodiment, the method further includes the steps of selectively directing make-up water into a first upper water distribution pan or a second upper water distribution tank, selectively pumping water from a lower water tank into said first or second water distribution pans; during ice making, distributing the water from said first water distribution pan and over an outer surface of said ice making plate; and, during the harvest cycle, distributing water from said second water distribution pan over an outer surface of the harvest gas generation plate.

In accordance with a preferred aspect of this embodiment, the method further includes collecting oil in an oil return system, located in the suction accumulator, having a U-shaped tube; and draining the oil through a weep hole in the U-shaped tube and directing the oil to a compressor.

BRIEF DESCRIPTION OF THE DRAWINGS

The apparatus of the present invention is further described and explained in relation to the following figures of the drawings wherein.

Like reference numerals are used to indicate like parts in all figures of the drawings.

DETAILED DESCRIPTION OF THE PREFERRED EMBODIMENT

Figure 1:
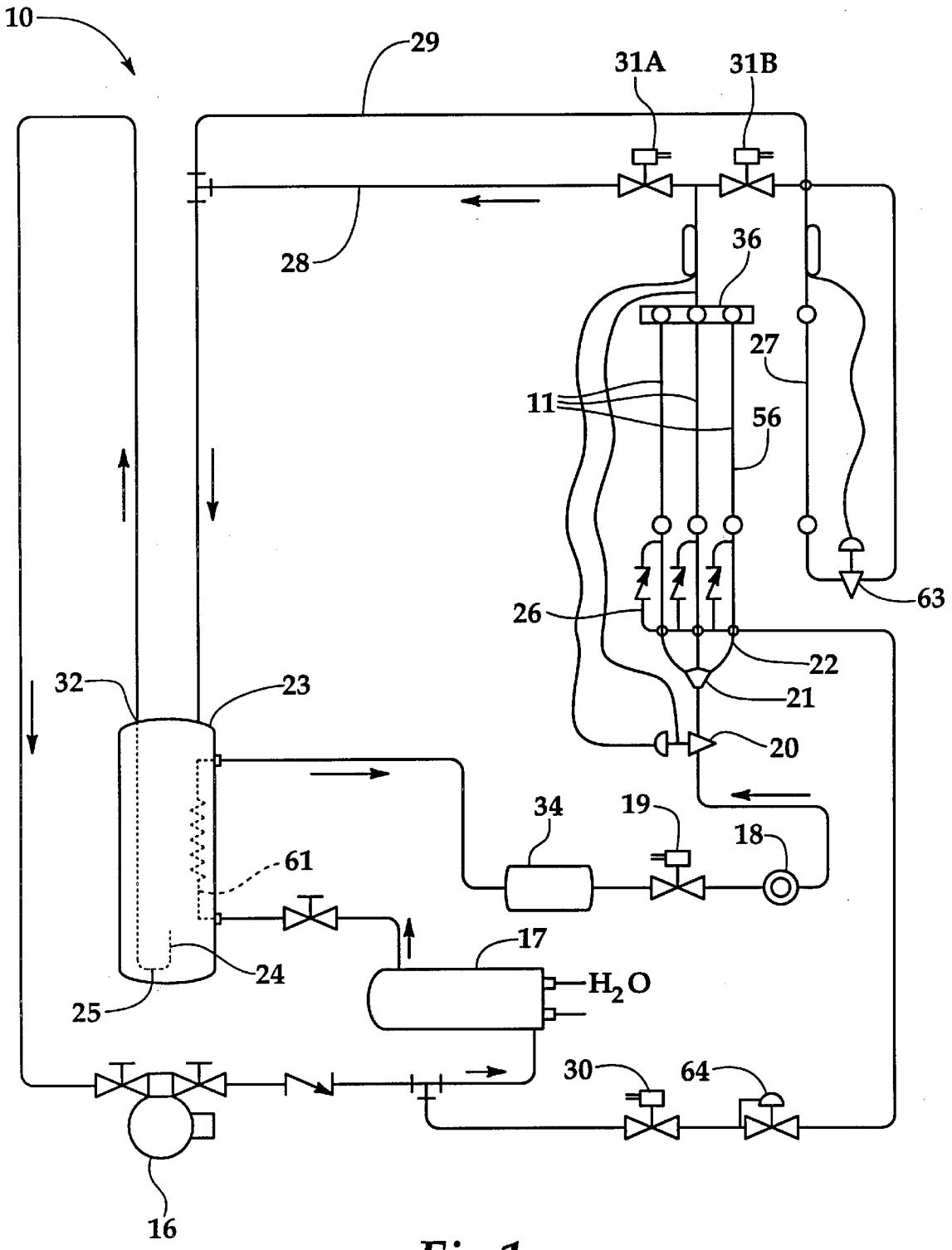
FIG. 1 is a schematic view of the refrigerant portion of the ice making system, shown during the ice making portion of the cycle.
Figure 2:
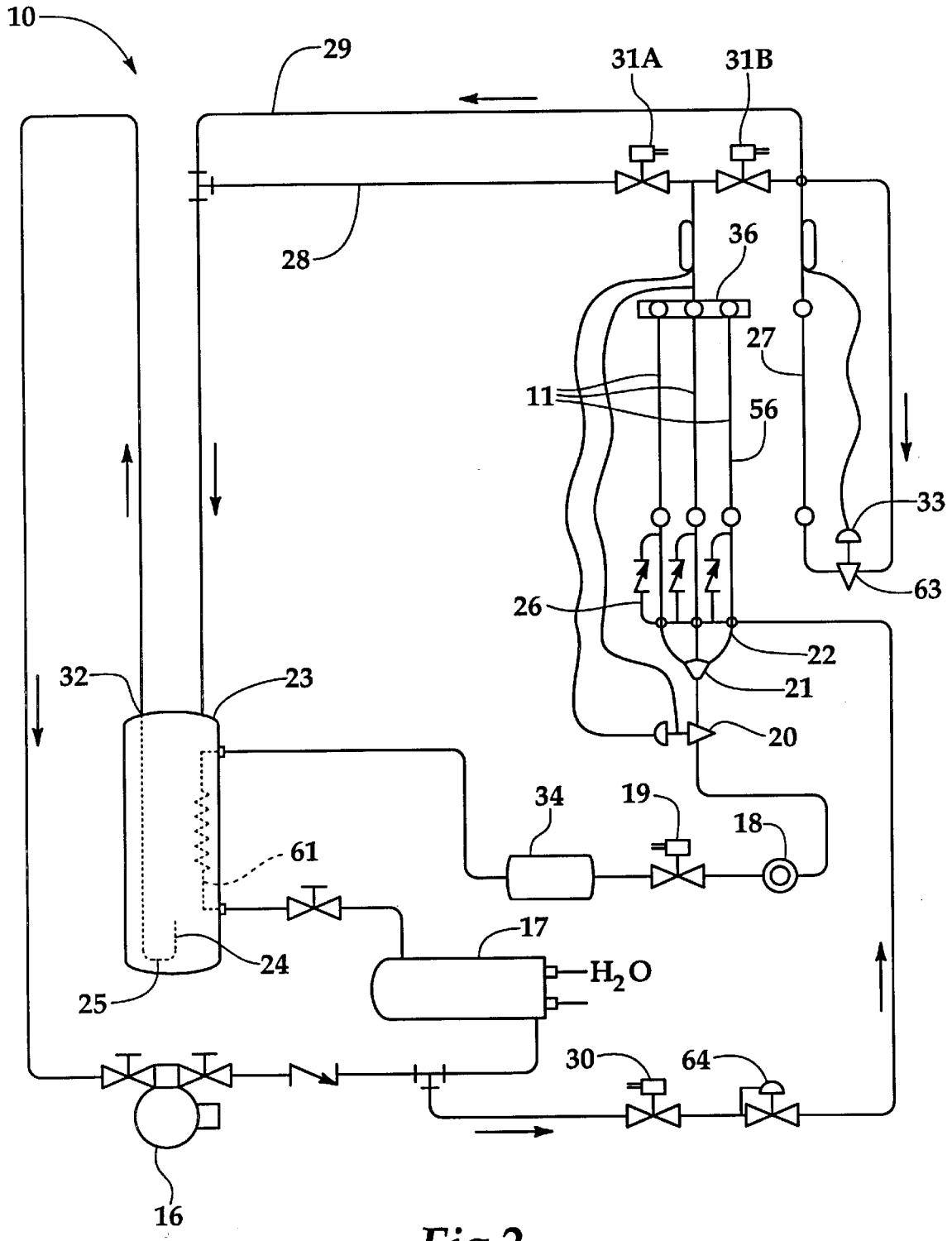
FIG. 2 is a schematic view of the refrigerant portion of the ice making system, shown during the ice harvest portion of cycle.

Referring now to the drawings in detail, and first to FIGS. 1 and 2, the refrigerant portion 10 of the ice making system of the present invention is depicted. The ice making refrigerant portion 10 preferably includes a standard semi-hermetic or scroll compressor 16, water-cooled condenser 17, heat exchanger 61, filter/dryer 34, liquid refrigerant solenoid valve 19, sight glass 13, thermal expansion salve 20, refrigerant distributor 21 and tubes 22, ice making plates 11, valves 31A and 31B, a suction accumulator 23, with a U-tube dry suction line 24 having a weep hole 25 for oil return, check valves 26 for each ice making plate, miscellaneous isolation valves harvest valve 30, a harvest gas pressure regulator 64, a harvest gas thermal expansion valve 63, and a harvest gas generator plate 27.

During ice making, refrigerant is compressed and heated in compressor 16 and directed to condenser 17, where it is condensed back into a liquid. The liquid refrigerant exits the condenser 17 and enters the liquid refrigerant side of heat exchanger 61 in suction accumulator 23, which additionally cools the liquid refrigerant. The liquid refrigerant exits heat exchanger 61, passes through filter/dryer 34 to filter and dry the refrigerant, and then onto liquid refrigerant solenoid valve 19. Liquid refrigerant is fed to each ice making plate 11 through the thermal expansion valve 20, through refrigerant distributor 21 and distributor tubes 22 by opening liquid solenoid valve 19 and closing harvest valve 30. Check valves in the auxiliary lines, connected to the inlet of each ice making plate, prevent back flow of refrigerant between the plates 11 to ensure good refrigerant distribution. During ice making, water flowing over the plates 11 evaporates the refrigerant, while cooling water flowing over the plates, freezing at least a portion of it into ice.

Downstream of plates 11, two, 2-way valves 31A and 31B direct the refrigerant gas leaving the ice making plates 11. During ice making, valve 31B is closed, preventing flow of refrigerant to the harvest gas generation plate 27. The other valve 31A is opened to allow flow of refrigerant to the suction accumulator 23. In the alternative, a single three-way valve could be substituted for valves 31A and 31B.

The evaporated refrigerant gas passes through line 28 to suction accumulator 23, which preferably includes heat exchanger 61. The gas exits the suction accumulator 23 through U-tube 24, which leads to suction outlet connection 32, which leads to the inlet of compressor 16. A small weep hole 25 at the bottom of the U-tube 24 located inside the vessel 23 returns oil that accumulates in the U-tube 24 to an oil return line (not shown) leading to the compressor 16.

In one size of the present ice make system 10, there are three 36" evaporator or ice making plates 11, preferably mounted in a suitable frame (not shown). Units to produce more ice can be used in tandem or units with as many additional ice making plates 11 as needed could be constructed. Ice making can be accomplished on both sides of the plates 11. The ice making plates 11 (also depicted in FIGS. 3 and 4) may be enclosed on three sides and the top by insulated panels (not shown).

Figure 3:
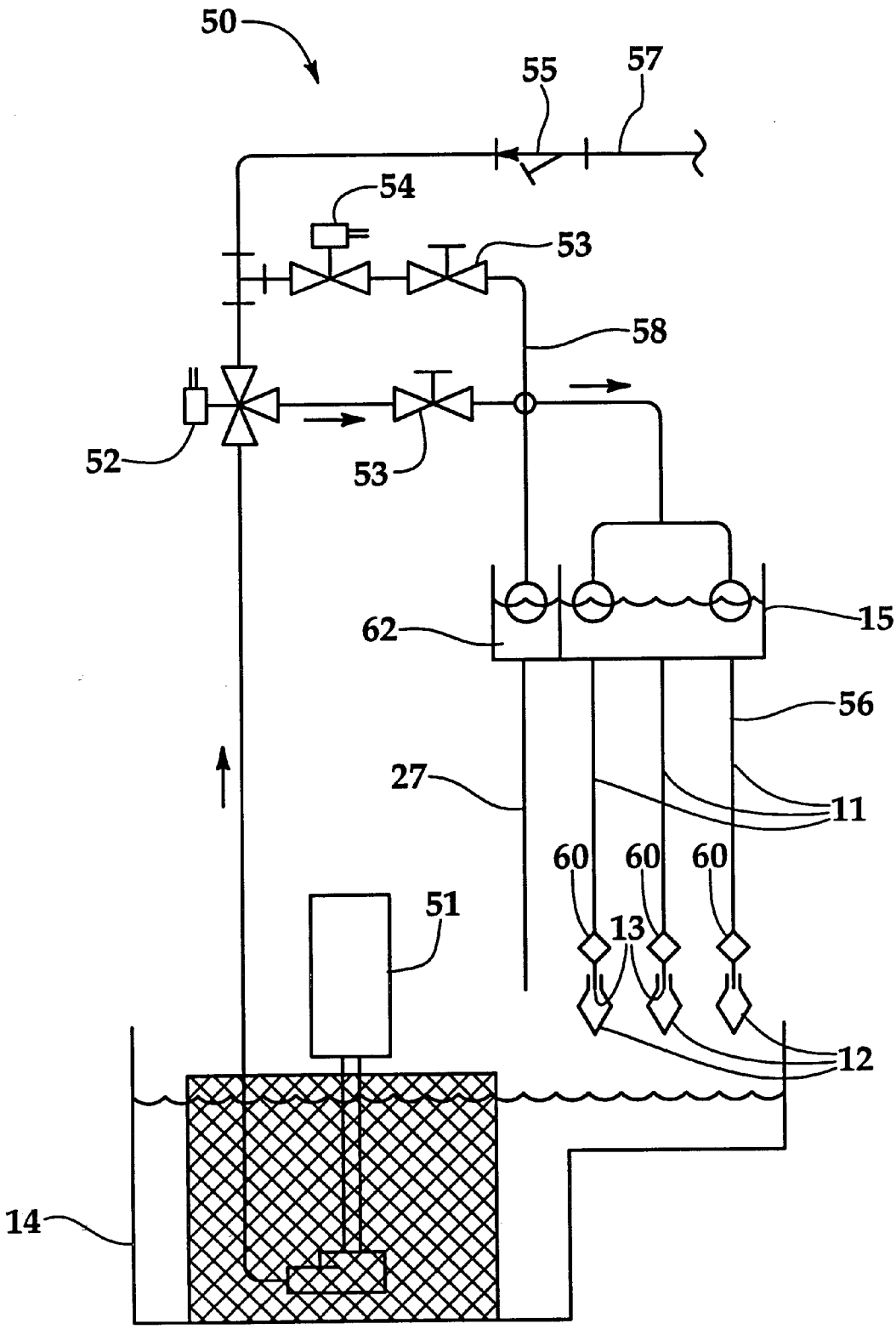
FIG. 3 is a schematic view of the water supply circuit for the ice making system of the present invention, shown during the ice making portion of the cycle.
Figure 4:
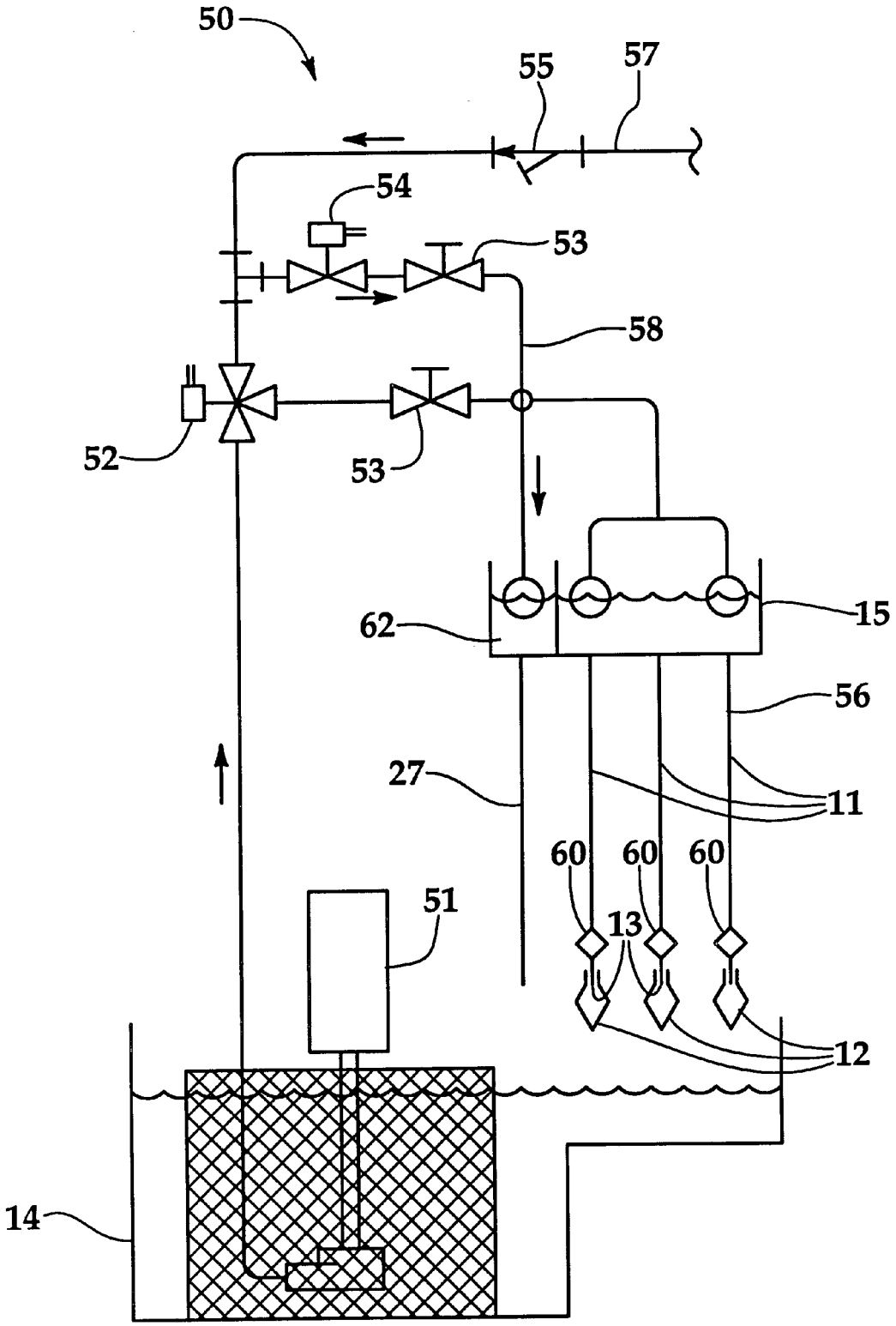
FIG. 4 is a schematic view of the water supply circuit for the ice making system of the present invention, shown during the ice making portion of the cycle.

With reference now primarily to FIGS. 3 and 4, the water distribution system 50 is depicted. The water distribution system or water supply circuit 50 consists of a water pump 51, water tank 14, a three-say solenoid valve 52, two flow control valves 53, make-up water solenoid valve 54, water strainer 55, a water distribution pan 15 for the make-up water for ice making and a water distribution pan 62 for the harvest gas generator water. In lieu of three-way solenoid valve 52, two 2-way valves may be substituted. See FIG. 3 for the ice making mode of the water supply circuit and see FIG. 4 for the ice harvest mode of the water supply circuit.

The bottoms of the ice making plates 11 are open for discharge of the ice during the harvest sequence to an ice collection bin (not shown). A water trough 12 is disposed under the bottom 13 of each ice making plate 11. This trough 12 collects the excess water flowing over the ice making plates 11 during ice making and returns it to a make-up water tank 14 located at the end of the plates. A bulbous obstruction 60 is preferably included near bottom of the plate 11, above the trough 12, to divert ice away from the water trough 12. The flat bottom water distribution pan 15 is mounted on top of the plates for water distribution.

Referring to FIG. 3, during ice making, as the water flows over the ice making plates 11, a layer of ice (not shown) is formed over the outer surface 56 of the plates, and the water level in the tank 14 decreases as the water is converted to ice. In the water supply circuit 50, a flow control valve 53 located in the water line 58 adjusts the water level in the pan 15 to the required level for proper water distribution to the outer surfaces 56 of the ice making plates 11.

With reference now to FIG. 2, the refrigerant portion of the harvest mode will be described. During the harvest mode, the harvest valve 30 is opened and the liquid solenoid 19 is closed, which causes gas to flow through pressure regulator 64 towards the ice making plates 11. The gas enters the ice making plates through a distributor in the inlet line at the bottom of the plates. With ice on the ice making plates 11 and the ice making plates at a temperature of 0–5° F. at the start of the harvest cycle 29 (shown in FIG. 2), the gas entering the ice making plates 11 is condensed to a liquid.

The liquid refrigerant leaves the ice making plates at the top outlet header 36. Valve 31B in the suction line is opened and the condensed liquid refrigerant is diverted to the inlet of the harvest gas generation plate 27 through thermal expansion valve 63 and the other valve 31A is closed to prevent flow to the suction accumulator 23. Ice separates from the ice making plates 11 and falls directly out through the bottom of the unit into an ice collection bin (not shown).

The present invention includes a harvest gas generator plate 27, which is conveniently an approximately 36 inch plate. See FIG. 1 for the ice making circuit see FIG. 2 for the ice harvesting circuit. In the ice generation system 10, all ice making plates 11 can be harvested at the same time.

As depicted in FIG. 4, during the harvest mode, the make-up water solenoid valve 54 is opened to provide water flow over the harvest gas generator plate 27 and to refill the water tank 14 with make-up water from make-up water line 57, which passes through filter 55, for the next ice making cycle. The water pump 51 continues to run but the three-way water solenoid valve 52 diverts the water flow from the main water distribution pan 15 to the make-up water distribution pan 62 above the harvest gas generation plate 27.

Make-up water at about 40–80 degrees F is flowed over the harvest gas generator plate 27. This causes refrigerant to be heated and evaporated and then to return to the suction accumulator as a gas. Due to the high temperature of the entering water, the temperature of the plate will preferably stay above freezing so ice will not form on the harvest gas generator plate 27. As the refrigerant is heated and evaporated, the make-up water flowing down plate 27 into water tank 14 is pre-chilled for the next ice making cycle.

A water trough 12 is not required for the harvest gas generation plate 27 since no ice is intended to be formed on this plate. Water flow is controlled by a timer (not shown). To increase flow, the timer leaves the make-up water solenoid valve on longer. To decrease the flow, the time is decreased. Water continues to circulate over the harvest gas generator plate 27 even after the make-up water solenoid valve is closed, as long as there is water in distribution pan 62. A flow control valve 53 is located in the harvest water flow line to provide adjustment of the rate of harvest water flow.

Preferably, a pressure switch (not shown) on the refrigerant side terminates the harvest cycle. Alternatively, the end of the harvest cycle can be controlled by a timer. At the end of the harvest cycle (about 60–90 seconds), the harvest gas valve 63 will be closed to cut off the supply of harvest gas to the ice making plates. Also, three-way water solenoid 52 (or, alternatively, two, 2-way valves, if used) will switch, thus divert the circulating water to flow over the ice making plates 11 after a short time delay.

The solenoid valve 31B will remain open and the solenoid valve 31A will remain closed for a time. This allows the refrigerant in the harvest gas generation plate 27 to be removed through the normal loading of the plate. The higher pressure liquid remaining in the ice making plates 11 will be driven out of these plates into the harvest gas generation plate 27 until the pressure becomes too low, i.e., when the pressure in ice making plates 11 approaches system suction pressure (24 PSIG for R-22). Valve 31A of the two-way suction solenoid valves is then opened to return the refrigerant to the suction accumulator 23 and valve 31B is closed to prevent flow to the harvest gas generation plate 27. No liquid carry-over should occur since the ice making plates 11 are already at or close to the normal evaporator pressure. Next the plate temperature is allowed to drop prior to turning on the circulating water flow to the ice making plates 11. Oil is returned through an oil return line (not shown) to the compressor 16 via the weep hole 25 in the suction outlet U-tube 24 located inside the vessel 23.

To start the ice maker 10, a master switch (not shown) is turned on, which causes the compressor 16 starts, the water pump 51 to start, the liquid solenoid valve 19 to open and valve 30 to close. This causes, the pull down of the plate and water temperature to begin. For a hot start-up, it is desirable to open the make-up water solenoid valve 54 to ensure the water tank 14 is full and the temperature of the water is lowered as much as possible. This water may also be circulated over the ice making plates 11 by pump 51 to do some pre-cooling of the plates before the compressor 16 is turned on.

The unit 10 is shut-down by either turning the master off, or when the contact in the control circuit (not shown) indicates the ice bin (not shown) is full, or when a failure condition has occurred. When normal shut-down occurs, the liquid solenoid 19 closes to pump the unit down prior to shut off. For efficiency, the current ice making cycle would be completed and the ice harvested prior to initiation of the pump-down sequence.

Other alteration and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

I claim:

1. An ice melting and harvesting system comprising:

a refrigerant system comprising:

a refrigerant compressor;

a condenser having an outlet;

an expansion valve to reduce the pressure of the refrigerant flowing from the condenser;

at least one ice making plate;

a harvest gas generator plate;

a valve to selectively direct gaseous refrigerant from the compressor towards the condenser during an ice making cycle and a valve to selectively direct said gaseous refrigerant towards said ice making plate during a harvest cycle;

a suction accumulator;

a heat exchanger having one side associated with said suction accumulator and one side associated with an outlet of said condenser;

a valve on the downstream side of said ice making plate to selectively direct refrigerant from the ice making plate to the suction accumulator during an ice making cycle and from the harvest gas generator plate to the suction accumulator during a harvest cycle;

a water supply circuit comprising;

a first upper water source for said ice making plate;

a second upper water source for said harvest gas generator plate;

a lower water tank;

a pump for pumping water from said lower water tank to said first and second upper water sources;

a source of make-up water; and a water supply valve for selectively directing water to said first upper water source to flow over said ice making plate during an ice making cycle and a water supply valve for selectively directing water to said second upper water source to flow over said harvest gas generator plate during a harvest cycle.

2. The ice making and harvesting system as described in claim 1 wherein the first upper water source is a water pan and said second upper water source is a water pan.

3. The ice making and harvesting system as described in claim 1 wherein the suction accumulator further comprises:

an oil return system collecting oil from the refrigerant having a U-shaped tube; and a weep hole in the U-shaped tube to return the collected oil to the compressor.

4. A method for making and harvesting ice comprising the steps of:

during an ice making cycle, directing liquid refrigerant to an ice making plate while flowing water over said ice making plate to evaporate said liquid refrigerant into a gas and create a layer of ice on said ice making plate;

during a harvest cycle:

directing gaseous refrigerant to an ice making plate having ice thereon;

condensing said gaseous refrigerant in said ice making plate to warm said ice making plate and loosen said ice;

directing condensed refrigerant from said ice making plate to a harvest gas generator plate;

flowing water onto said harvest gas generator plate to warm said harvest gas generator plate and evaporate said condensed refrigerant into a gaseous refrigerant while cooling said water above its freezing point;

directing said gaseous refrigerant from said harvest gas generator plate to a suction accumulator;

directing water flowed onto said harvest gas generator plate into a water tank; and during an ice making cycle, directing water from said water tank onto said ice making plate.

5. The method for making and harvesting ice as described in claim 4 further comprising the steps of:

selectively directing make-up water into a first upper water distribution pan or a second upper water distribution tank, selectively pumping water from a lower water tank into said first or second water distribution pans;

during ice making, distributing the water from said first water distribution pan and over an outer surface of said ice making plate; and during the harvest cycle, distributing water from said second water distribution pan over an outer surface of the harvest gas generation plate.

6. The method for making and harvesting ice as described in claim 5 further comprising the steps of:

collecting oil in an oil return system, located in the suction accumulator, having a U-shaped tube; and draining, the oil through a weep hole in the U-shaped tube and directing the oil to a compressor.

* * * * *

UNITED STATES PATENT AND TRADEMARK OFFICE

CERTIFICATE OF CORRECTION

PATENT NO. : 6,145,324

DATED : November 14, 2000

INVENTOR(S) : Dolezal

It is certified that error appears in the above-identified patent and that said Letters Patent are hereby corrected as shown below:

Column 3, line 60, change "salve" to "valve"
Column 4, line 47, change "three-say" to "three-way"

Signed and Sealed this

Fifteenth Day of May, 2001

*Attest:*

Nicholas P. Godici

NICHOLAS P. GODICI

*Attesting Officer*

*Acting Director of the United States Patent and Trademark Office*